US007841476B2

(12) United States Patent
Johnson et al.

(10) Patent No.: US 7,841,476 B2
(45) Date of Patent: Nov. 30, 2010

(54) SCREENING MODULE RETAINING MEMBER

(75) Inventors: Ronald Leslie Johnson, Warners Bay (AU); Ronald Keith McGregor, Newcastle (AU)

(73) Assignee: Ludowici Australia Pty Ltd, Brisbane (AU)

( * ) Notice: Subject to any disclaimer, the term of this patent is extended or adjusted under 35 U.S.C. 154(b) by 663 days.

(21) Appl. No.: 11/576,069

(22) PCT Filed: Sep. 9, 2005

(86) PCT No.: PCT/AU2005/001376

§ 371 (c)(1),
(2), (4) Date: Oct. 5, 2007

(87) PCT Pub. No.: WO2006/034526

PCT Pub. Date: Apr. 6, 2006

(65) Prior Publication Data

US 2008/0035533 A1 Feb. 14, 2008

(30) Foreign Application Priority Data

Sep. 27, 2004 (AU) ..... 2004905590

(51) Int. Cl.
*B07B 1/49* (2006.01)

(52) U.S. Cl. ..... 209/405; 209/392; 209/399; 209/403; 209/408; 403/408.1

(58) Field of Classification Search ..... 209/392, 209/399, 403, 405, 408; 403/408.1
See application file for complete search history.

(56) References Cited

U.S. PATENT DOCUMENTS 4,141,821 A * 2/1979 Wolff ..... 209/405
4,909,929 A * 3/1990 Tabor ..... 209/400
4,990,023 A * 2/1991 Angelov et al. ..... 403/408.1

(Continued)

FOREIGN PATENT DOCUMENTS

DE 3607660 9/1987

(Continued)

OTHER PUBLICATIONS

Letter dated Oct. 30, 2007 containing English translation of the Chilean Examination report.

*Primary Examiner*—Gene Crawford
*Assistant Examiner*—Terrell H Matthews
(74) *Attorney, Agent, or Firm*—Wong, Cabello, Lutsch, Rutherford & Brucculeri, L.L.P.

(57) ABSTRACT

A screening module retaining member 10 includes a body member 12 defining a passage 16. A retaining element 14 is displaceably arranged in the passage 16. The retaining element 14 is displaceable between a first, non-retaining position in which the retaining member is accessible from a first end of the body member 12 and a second, retaining position in which the retaining element 14 is received within the passage 16 and acts on at least a part 20 of the body member 12 for retaining the body member 12 in position relative to a component of a screen deck. A locating arrangement 22 is associated with the first end of the body member 12 for locating a screening module relative to the screen deck and for inhibiting lateral movement of the screening module relative to the body member 12.

17 Claims, 2 Drawing Sheets

U.S. PATENT DOCUMENTS

| | | | | |
|---|---|---|---|---|
| 5,277,319 | A * | 1/1994 | Henry, Jr. | 209/399 |
| 5,769,241 | A * | 6/1998 | Woodgate | 209/399 |
| 6,206,200 | B1 * | 3/2001 | Gilles et al. | 209/399 |
| 7,621,406 | B2 * | 11/2009 | Freissle et al. | 209/405 |
| 2003/0038060 | A1 * | 2/2003 | Freissle et al. | 209/405 |

FOREIGN PATENT DOCUMENTS

| | | |
|---|---|---|
| WO | 00/64599 | 2/2000 |
| WO | 03/066243 | 8/2003 |

* cited by examiner

SCREENING MODULE RETAINING MEMBER

CROSS-REFERENCE TO RELATED APPLICATIONS

The present application claims priority from Australian Provisional Patent Application No 2004905590 filed on 27 Sep. 2004, the contents of which are incorporated herein by reference.

FIELD OF THE INVENTION

This invention relates to screening systems. More particularly, the invention relates to a screening module retaining member and to a screening module assembly including such retaining member.

BACKGROUND TO THE INVENTION

Screening systems are used for classifying ores. These screening systems use foraminous screening members which pass material of a predetermined size and block material of larger size.

The screening members are removably attached to a screen deck as they wear rapidly and need to be replaced. Various forms of attachment are used for attaching screening members to the screen deck. These forms of attachment include rails, pins, or other attachment elements which releasably retain the screen members on the screen deck.

One problem with these different arrangements is that, if the screen deck is configured to have screening members with an attaching system of a first type attached to the screen deck, the screen deck cannot be used with screening members of a type having a different attaching system.

In certain situations, the means by which the screening members are attached to the screen deck stand proud of an upper surface of the screening members. A problem with this arrangement is that it reduces the screening area of the screening members and impedes flow of material over the upper surfaces of the screening members.

SUMMARY OF THE INVENTION

According to a first aspect of the invention, there is provided a screening module retaining member which includes:

a body member defining a passage;

a retaining element displaceably arranged in the passage, the retaining element being displaceable between a first, non-retaining position in which the retaining member is accessible from a first end of the body member and a second, retaining position in which the retaining element is received within the passage and acts on at least a part of the body member for retaining the body member in position relative to a component of a screen deck; and a locating arrangement associated with the first end of the body member for locating a screening module relative to the screen deck and for inhibiting lateral movement of the screening module relative to the body member.

The body member may be a moulding of a resiliently flexible material. For example, the body member may be a moulding of a polymeric material such as a polyurethane material.

The body member may comprise a boss defining the first end with an engaging assembly extending from, and formed integrally with, the boss, a free end of the engaging assembly defining a second end of the body member. The passage may be an open passage extending from the first end of the body member to the second end of the body member and, when the retaining element is in its first position relative to the body member, a portion of the retaining element extends outwardly from the first end of the body member.

The engaging assembly may comprise a plurality of engaging elements. The engaging elements may be interconnected. Adjacent engaging elements may be interconnected by webbing which defines a zone of weakness between the adjacent engaging elements.

The passage may define a first holding formation for holding the retaining element in its first position and a second holding formation, spaced from the first holding formation, for holding the retaining element in its second position. Each of the first holding formation and the second holding formation may be in the form of a radially outwardly extending circumferential groove formed in a wall of the passage.

The retaining element may include a complementary structure, in the form of a circumferential rib, which is received in the first holding formation when the retaining element is in its first position and in the second holding formation when the retaining element is in its second position.

In one embodiment of the invention, the locating arrangement may be in the form of a radially outwardly extending lip defined proximate the first end of the body member which engages a complementary recess of the screening module. In addition, an opening of the passage at the first end of the body member, after the retaining element has been displaced to its second position, may be configured to receive a locating member of the screening module for inhibiting lateral movement of the screening module relative to the body member and to the screen deck.

In another embodiment of the invention, the locating arrangement may comprise at least one clip-like formation which stands proud of the first end of the body member to be engaged by a complementary clip-like formation of the screening module for releasably attaching the screening module to the screen deck and for inhibiting lateral movement of the screening module relative to the retaining element and the screen deck.

According to a second aspect of the invention, there is provided a screening assembly which includes:

at least one retaining member, as claimed in any one of the preceding claims; and at least one screening module releasably attachable to the retaining member, the screening module including at least one complementary formation for engaging the locating arrangement of the at least one retaining member.

BRIEF DESCRIPTION OF THE DRAWINGS

Embodiments of the invention are now described by way of example with reference to the accompanying drawings in which: —

DETAILED DESCRIPTION OF EXEMPLARY EMBODIMENTS

Figures 1, 2, 3, 4, 5, 6, 7:
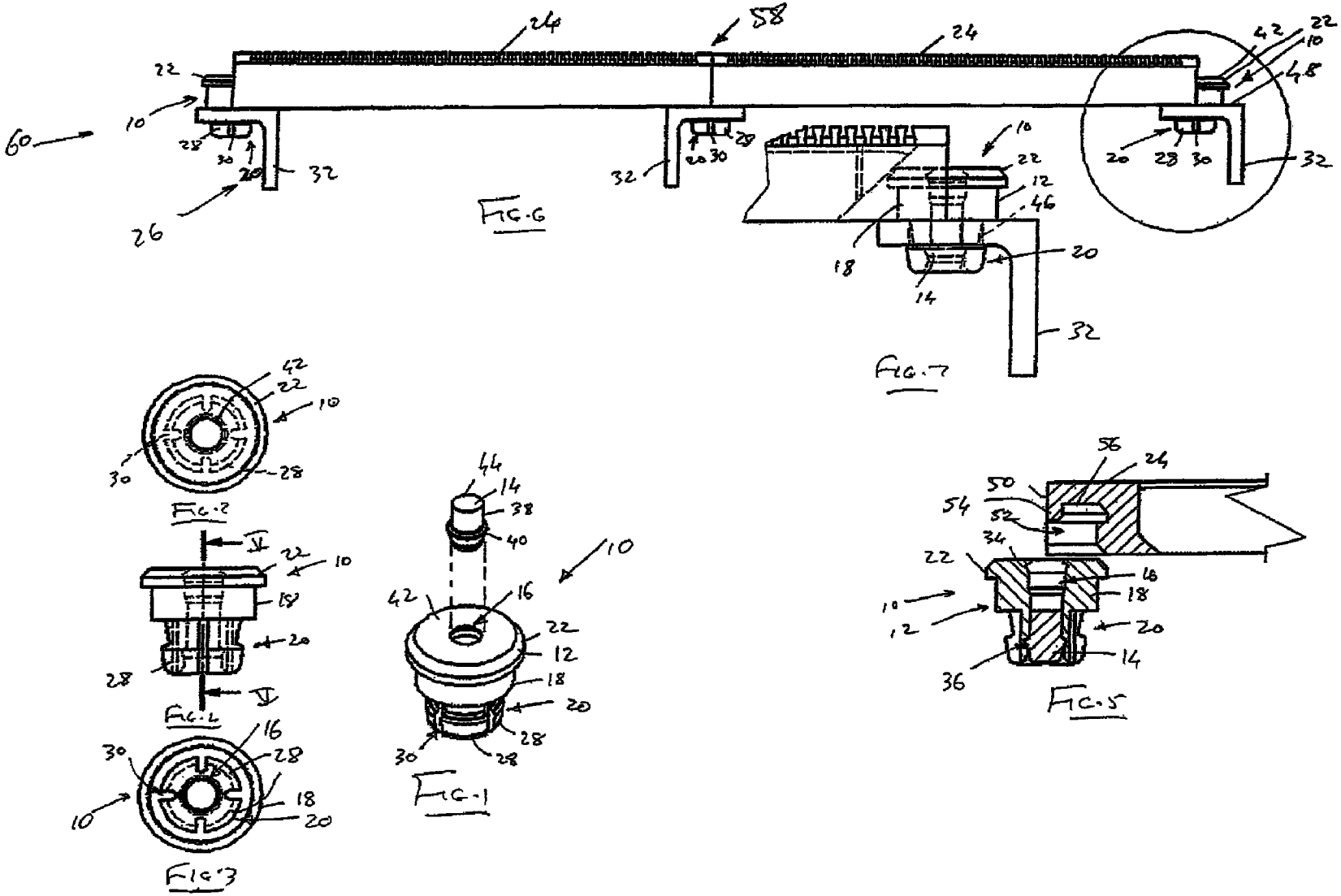
FIG. 1 shows a three dimensional, exploded view of a screening module retaining member, in accordance with an embodiment of a first aspect of the invention.
FIG. 2 shows a plan view of the retaining member of FIG. 1.
FIG. 3 shows a bottom view of the retaining member of FIG. 1.
FIG. 4 shows a side view of the retaining member of FIG. 1.
FIG. 5 shows a sectional end view of part of a screening assembly in accordance with a first embodiment of a second aspect of the invention, the side view of the retaining member of the assembly being taken along line V-V in FIG. 4 of the drawings.
FIG. 6 shows an end view of the screening assembly.
FIG. 7 shows, on an enlarged scale, the circled part of the screening assembly of FIG. 6.

Referring to the drawings, reference numeral 10 generally designates a screening module retaining member in accordance with an embodiment of the invention. The retaining member 10 includes a body member 12 and a retaining element 14 displaceably arranged in a passage 16 of the body member 12.

As shown most clearly in FIG. 5 of the drawings, the body member 12 of the retaining member 10 includes a boss 18 with an engaging assembly 20 extending from the boss 18.

The body member 12 also defines a locating arrangement 22 for locating a screening module 24 relative to a screen deck 26 (FIG. 6) and the retaining member 10.

The engaging assembly 20 comprises a plurality of discrete engaging elements 28 arranged in a substantially petaloid fashion. Adjacent engaging elements 28 are separated from each other by webbing defining a zone of weakness in the form of a groove or a slot 30 to facilitate insertion of the engaging assembly 20 into a rail 32 of the screen deck 26, as will be described in greater detail below.

The passage 16 defines a first holding formation, in the form of a radially outwardly extending groove 34, proximate its first end and a second such holding formation, also in the form of a groove 36, inwardly of its second end.

The retaining element 14 is a substantially cylindrical spigot-like member, or pin, 38 having a radially outwardly extending circumferential rib 40 proximate a second end of the pin 38. When the retaining element 14 is in its first position relative to the body member 12, part of the pin 38 stands proud of an upper surface 42 at a first end of the body member 12 with the rib 40 received in the first groove 34. This enables a first end 44 of the pin 38 to be engaged by an installation tool (not shown) for driving the pin 38 from its first position to a second, displaced position as shown in FIG. 5 of the drawings in which the rib 40 of the retaining element 14 is received in the second groove 36. The Applicant envisages using a special installation tool (not shown) configured to displace the pin 38 from its first position to its second position in which the rib 40 is received in the second groove 36 of the passage 16 but not to drive the pin 38 too far into the passage to a position where the rib 40 would overshoot the second groove 36.

Thus, in use, the retaining member 10 is provided with the pin 38 in its first position. The body member 12 is inserted through an opening 46 in the rail 32 of the screen deck 26. In this regard, it will be noted that the openings 46 are arranged at regularly spaced intervals along each rail 32 of the screen deck and a retaining member 10 is received in each opening 46. Once the retaining members 10 have been placed in position on the rails 32 of the screen deck, the pin 38 of each retaining member 10 is driven to the position shown in FIG. 5 of the drawings. This causes the engaging elements 28 of the engaging assembly 20 of the body member 12 to splay slightly outwardly securely locking the body member 12 to the rail 32. In this position, the boss 18 sits on a horizontal surface 48 of each rail 32. The locating arrangement 22 stands proud of the surface 48 of the rail 32. A feature of the retaining member 10 is that, to remove the retaining member 10 from the rail 32, the pin 38 is driven all the way through and out of the second end of the passage 16. This releases the engaging elements 28 allowing the body 12 to be withdrawn from the opening 46 in the rail 32. Hence, there is no need to replace or change the rail 32 when it is necessary or desired to replace the retaining members 10.

Referring once again to FIG. 5 of the drawings, it is to be noted that a side 50 of the screening module 24 has a receiving zone or recess 52 which has a shape that approximates half of the boss 18 of the retaining member 10. The end 50 of the screening module 24 is thus clipped into position over the boss 18 of the body member 12 of the retaining member 10. A downwardly projecting tab 54 at the side 50 of the screening module 24 is received in the first end of the passage 16. This assists in securing the screening module 24 laterally relative to the retaining member 10 and to the rail 32 of the screen deck 26. The surface 42 defines a land against which a horizontal surface 56 of the recess 52 at the side 50 of the screening module bears which assists in stabilising the module 24 relative to the retaining members 10.

Adjacent screening modules 24 are arranged in side-by-side abutment, as shown in FIG. 6 of the drawings, with the side 50 of one screening module 24 overlying one half of the boss 18 of the retaining member 10 with the other side of the adjacent screening module 24 overlying the other half of the boss 18 of the retaining member 10. The tabs 54 of the abutting sides 50 of the screening modules 24 are received in the passage 16 of the retaining member 10 and abut against each other to assist in lateral retention of the screening modules 24.

Thus, a screening system 60 comprising a plurality of the retaining members 10 received in rails 32 of the screen deck 26 with screening modules 24 secured to the retaining members 10 is provided.

Figure 8:
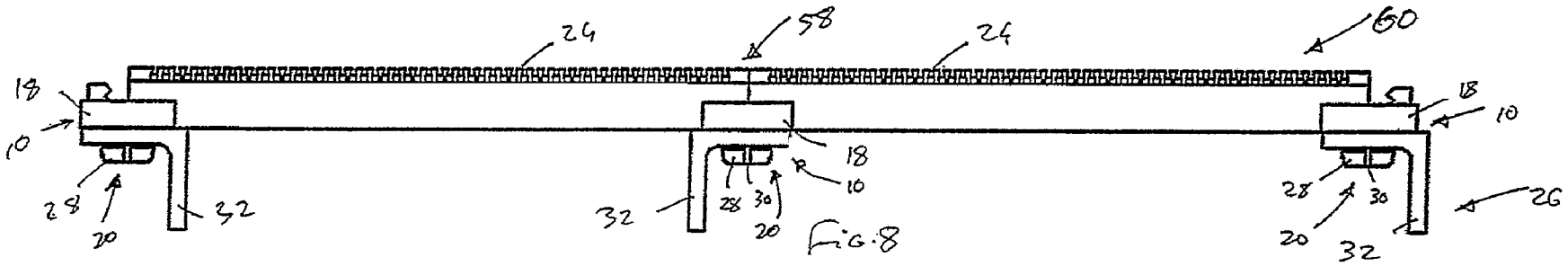
FIG. 8 shows an end view of a screening assembly in accordance with a further embodiment of the second aspect of the invention.
Figure 9:
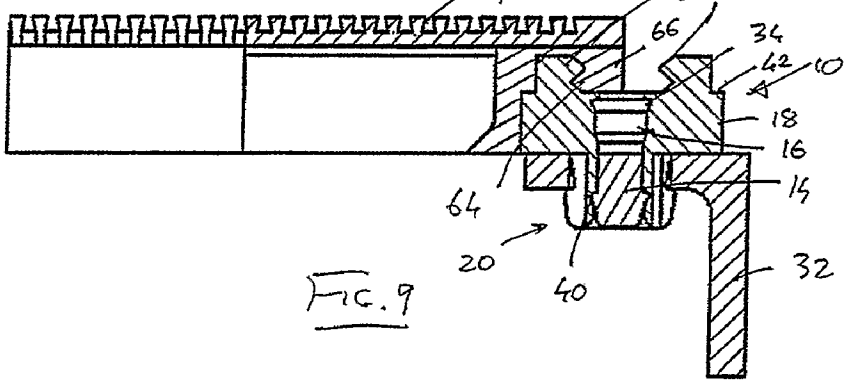
FIG. 9 shows a sectional end view of a part of the screening assembly of FIG. 8.

Referring to FIGS. 8 and 9 of the drawings, yet another embodiment of a screening system 60 is illustrated. With reference to FIGS. 1 to 7 of the drawings, like reference numerals refer to like parts, unless otherwise specified.

In this embodiment of the invention, the retaining arrangement 22 of the boss 18 of the retaining member 10 includes a pair of opposed clip-like formations, or clips 62, standing proud of the surface 42 of the boss 18. These clips 62 are rectilinear and the boss 18 is square or rectangular as opposed to the circular boss 18 of the retaining member 10 shown in FIGS. 1 to 7 of the drawings.

The retaining member 10 of the embodiment of the invention shown in FIGS. 8 and 9 of the drawings is for use with a screening module 24 having a clip-like formation 64 running along each side 66 of the screening module 24. Thus, in this embodiment of the invention, the screening module 24 is retained in position relative to the retaining member 10 by clipping engagement between the clips 62 of the retaining member 10 and the clip-like formation 64 of the screening module 24. It will be appreciated that, with this arrangement, the clips 62 engaging with the clip-like formation 64 of each screening module 24 serve also to retain the screening module 24 laterally with respect to the retaining members 10 and, as a result, the screen deck 26.

Although the body member 12 and retaining member 14 are moulded separately, prior to use the retaining element 14 is driven into its first position relative to the body member 12 and is retained in that position by the rib 40 engaging the groove 34 at the first end of the passage 16 of the body member 12. The retaining member 10 is supplied in this configuration. As described above, once the body member 12 has been inserted into the hole 46 in the rail 32, the retaining element 14 is driven into its second position where the rib 40 engages the groove 36 inwardly of the second end of the passage 16 of the body member 12 to hold the retaining element 14 in its second position relative to the body member 12.

It is therefore an advantage of the invention that a retaining member 10 is provided with the retaining element 14 secured relative to the body member 12. Hence, there is no necessity to locate a separate pin in order to insert and retain the retaining member in position relative to the rail 32. It will be appreciated that screen decks 26 are often used in hostile environments and it is very easy to lose small, separate pieces. The provision of the retaining member 10 in accordance with an embodiment of the invention largely overcomes this problem.

It is a further advantage of the invention that a screening system 60 is provided which is more versatile in that, by use of the retaining member 10, a screen deck 26 can be modified to accept screening modules 24 which are either of the pin-attaching type or of the rail/clip-attaching type. Hence, with the provision of the retaining member 10 screening modules 24 can be used with either a pin-type screen deck or a rail-type screen deck.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A screening module retaining member which includes:

a body member defining a passage;

a retaining element displaceably arranged in the passage, the retaining element being displaceable between a first, non-retaining position in which the retaining element is accessible from a first end of the body member and a second, retaining position in which the retaining element is received within the passage and acts on at least a part of the body member for retaining the body member in position relative to a component of a screen deck; and a locating arrangement associated with the first end of the body member for locating a screening module relative to the screen deck and for inhibiting lateral movement of the screening module relative to the body member wherein the passage defines a first holding formation for holding the retaining element in its first position and the retaining element includes a complementary structure which is received in the first holding formation when the retaining element is in its first position.

2. The retaining member of claim 1 wherein the body member is a moulding of a resiliency flexible material.

3. The retaining member of claim 1 wherein the body member comprises a boss defining the first end with an engaging assembly extending from, and formed integrally with, the boss, a free end of the engaging assembly defining a second end of the body member.

4. The retaining member of claim 3 wherein the passage is an open passage extending from the first end of the body member to the second end of the body member and, when the retaining element is in its first position relative to the body member, a portion of the retaining element extends outwardly from the first end of the body member.

5. The retaining member of claim 3 wherein the engaging assembly comprises a plurality of engaging elements.

6. The retaining member of claim 5 wherein the engaging elements are interconnected.

7. The retaining member of claim 6 wherein adjacent engaging elements are interconnected by webbing which defines a zone of weakness between the adjacent engaging elements.

8. The retaining member of claim 1 wherein the passage further defines a second holding formation, spaced from the first holding formation, for holding the retaining element in its second position.

9. The retaining member of claim 8 wherein the complementary structure of the retaining element is received in the second holding formation when the retaining element is in its second position.

10. The retaining member of claim 1 wherein the locating arrangement is in the form of a radially outwardly extending lip defined proximate the first end of the body member which engages a complementary recess of the screening module.

11. The retaining member of claim 10 wherein opening of the passage at the first end of the body member, after the retaining element has been displaced to its second position, is configured to receive a locating member of the screening module for inhibiting lateral movement of the screening module relative to the body member and to the screen deck.

12. The retaining member of claim 1 wherein the locating arrangement comprises at least one clip-like formation which stands proud of the first end of the body member to be engaged by a complementary clip-like formation of the screening module for releasably attaching the screening module to the screen deck and for inhibiting lateral movement of the screening module relative to the retaining element and the screen deck.

13. A screening assembly comprising:

a screening module retaining member which includes:

a body member defining a passage; a retaining element displaceably arranged in the passage, the retaining element being displaceable between a first, non-retaining position in which the retaining element is accessible from a first end of the body member and a second, retaining position in which the retaining element is received within the passage and acts on at least a part of the body member for retaining the body member in position relative to a component of a screen deck; and a locating arrangement associated with the first end of the body member for locating a screening module relative to the screen deck and for inhibiting lateral movement of the screening module relative to the body member wherein the passage defines a first holding formation for holding the retaining element in its first position and the retaining element includes a complementary structure which is received in the first holding formation when the retaining element in its first position; and at least one screening module releasably attachable to the retaining member, the screening module including at least one complementary formation for engaging the locating arrangement of the at least one retaining member.

14. A method of mounting a screening module on a screen deck having a plurality of spaced, parallel rails with a plurality of spaced openings being defined in each rail, the method including the steps of mounting a retaining member in each of at least some of the holes of the rails of the screen deck;

securing each retaining member in position by displacing a retaining element having complementary structure from a first, non-retaining position in a first holding formation passage of a body member of the retaining member in which the retaining element is accessible from a first end of the body member to a second, retaining position in which the retaining element is received within the passage and acts on at least a part of the body member for retaining the body member in position relative to the rail; and mounting a screening module on the rails by the screening module engaging a locating arrangement associated with the first end of the body member of the retaining member for locating the screening module relative to the screen deck and for inhibiting lateral movement of the screening module relative to the retaining member.

15. The method of claim 14 including the step of causing the at least a part of the body member of the retaining member to move to a locking position when the retaining element is displaced from its first position to its second position to retain the retaining member in position relative to its associated rail.

16. The method of claim 14 including the step of clipping the screening module to the body member of the retaining member, on one side of the retaining member, and clipping another screening module to the retaining member, on an opposed side of the retaining member, so that the screening modules abut against each other to assist in lateral retention and to inhibit demounting of the screening modules from their associated retaining members.

17. The method of claim 14 including the step of driving the retaining element completely through the passage when it is desired to remove the retaining member from the rail.

* * * * *